US008220366B1

(12) United States Patent
Fierro et al.

(10) Patent No.: US 8,220,366 B1
(45) Date of Patent: Jul. 17, 2012

(54) SELF-CENTERING DRIVE SOCKET ASSEMBLY AND METHOD

(75) Inventors: John Fierro, Lewis Center, OH (US); Mark Roop, Saint Paris, OH (US)

(73) Assignee: Honda Motor Co., Ltd., Tokyo (JP)

( * ) Notice: Subject to any disclaimer, the term of this patent is extended or adjusted under 35 U.S.C. 154(b) by 338 days.

(21) Appl. No.: 12/582,239

(22) Filed: Oct. 20, 2009

(51) Int. Cl.
*B25B 23/16* (2006.01)
*B25B 13/02* (2006.01)

(52) U.S. Cl. ..... 81/177.85; 81/125; 81/177.2

(58) Field of Classification Search ..... 81/177.85, 81/177.8, 177.9, 177.7, 177.75, 124.6, 125, 81/44, 177.2
See application file for complete search history.

(56) References Cited

U.S. PATENT DOCUMENTS

| | | | | |
|---|---|---|---|---|
| 1,398,116 | A | 11/1921 | Root | |
| 1,669,862 | A * | 5/1928 | Christianson et al. | 74/505 |
| 3,897,703 | A * | 8/1975 | Phipps | 81/177.75 |
| 4,290,203 | A | 9/1981 | Rebman | |
| 4,400,885 | A | 8/1983 | Consales | |
| 4,485,562 | A | 12/1984 | De Fazio | |
| 4,599,036 | A | 7/1986 | Tarbuck | |
| 4,661,037 | A | 4/1987 | Sugino et al. | |
| 4,800,802 | A | 1/1989 | Rebman | |
| 5,116,190 | A | 5/1992 | Silke | |
| 5,577,902 | A | 11/1996 | Todo et al. | |
| 5,609,079 | A | 3/1997 | Hashimoto | |
| 5,692,790 | A | 12/1997 | Panyard | |
| 5,697,534 | A | 12/1997 | Huyghe | |
| 6,145,416 | A | 11/2000 | Bonniot | |
| 6,877,936 | B2 * | 4/2005 | Linderholm et al. | 408/1 R |
| 6,951,153 | B2 * | 10/2005 | Berthlaume | 81/44 |
| 2005/0235785 | A1 | 10/2005 | Chang | |

FOREIGN PATENT DOCUMENTS

| | | | |
|---|---|---|---|
| JP | 10-100090 | A | 4/1998 |

* cited by examiner

*Primary Examiner* — Hadi Shakeri
(74) *Attorney, Agent, or Firm* — Standley Law Group LLP

(57) ABSTRACT

A self-centering drive socket device and associated installation method. The device includes a socket member, coupler and sliding lock body. The sliding lock body is preferably connected to a drive mechanism that provides rotational movement. The device and method allows for the installation of misaligned fasteners by disengaging the sliding lock body from a cavity in the coupler so that the socket member becomes freely angularly displaceable with respect to a central axis of the device.

20 Claims, 7 Drawing Sheets

SELF-CENTERING DRIVE SOCKET ASSEMBLY AND METHOD

INVENTIVE FIELD

The present invention is directed to a device and method for installing fasteners. More particularly, the present invention is directed to a device and method that allows for the installation of fasteners while compensating for misalignment.

BACKGROUND OF THE INVENTIVE FIELD

Development of cost effective devices and methods for increasing manufacturing productivity is of prime concern in industry. One aspect of manufacturing that contributes to increased manufacturing costs is ineffective production assembly. In an effort to reduce the number of man-hours devoted to assembly, automated devices have been developed for the assembly of mating parts or components such as by securing with a bolt or nut. More advanced automated assembly devices may be robotic or otherwise programmable, and may be utilized to assemble more complicated items.

Regardless of the sophistication of assembly machines or devices, difficulties may be nonetheless encountered in accommodating misalignment between components or fasteners used to secure components. In the latter case, for example, automated assembly of components using threaded fasteners may depend on the repeatable alignment of a male fastener and a like-threaded hole or nut. Misalignment of these elements may be problematic to the assembly process.

In one particular such automated process, for example, a robotic driver device or similar mechanism having a drive socket may pick up a bolt from one repeatable location and present the bolt to a component assembly for installation to a nut at a second repeatable location. However, the location of a nut to which the bolt will be installed may vary as a result of many different factors. Therefore, on occasion, the bolt may be misaligned with the nut, preventing installation of the bolt by the robot or causing a cross-thread installation of the bolt into the nut.

Providing a drive socket device or similar tool with the ability to move or float in order to engage and install misaligned or out-of-position fasteners is recognized as a potential solution to this problem. It must be remembered, however, that such a device must also exhibit sufficient rigidity during at least the pick-up and driving portions of an installation operation. Particularly, such a device is generally required to pick up a fastener from a repeatable supply location, at which time the device should be substantially rigid and in a default position. The same condition should apply at the time of fastener presentation to a component assembly, nut, etc., as well as during actual fastener installation (i.e., driving). Conversely, upon contact with an out-of-place fastener at pick up, or upon partial contact with a misaligned nut, it would be desirable if such a device could exhibit sufficient flexibility to nonetheless complete the pick up or installation operation in a proper manner. Such a device must also be strong enough to withstand the torque requirements imparted by every day use.

Consequently, it can be understood that there is a need for a device and method for facilitating fastener installation. Preferably, such a device and method would allow for installation of fasteners easily and in a timely manner. Such a device may also be designed for use with fasteners of different materials, geometries and/or sizes. Preferably, such a device would be adjustable between rigid and flexible conditions. In the rigid arrangement, the device would be capable of repeated movement between target locations, and of driving a threaded fastener, such as a bolt. In the flexible arrangement, the device would be capable of installing fasteners exhibiting some degree of misalignment, and may also be capable of picking up fasteners not located at a precise supply location. A device and method of the present invention satisfies these needs/preferences.

SUMMARY OF THE GENERAL INVENTIVE CONCEPT

The present invention is directed to a device for installing fasteners and to an automated method of using said device to select and install fasteners. More particularly, the present invention is directed to a device and method that allows for the installation of fasteners by compensating for improper positioning and/or misalignment. Embodiments of the present invention may be usable to install fasteners of different materials, sizes and/or geometries. A device of the present invention generally includes a socket member, a proximal end of which is retained in a coupler. A sliding lock body may be inserted into a cavity within the coupler and retained on the proximal end of the socket member. The sliding lock body and the socket member may be biased toward a distal end of the coupler by a spring that resides in the coupler cavity and is trapped between the proximal end of the socket member and a drive member of a driven bolt driver. In its normal biased position, the device is substantially rigid and the socket member and coupler are substantially aligned about a central longitudinal axis. However, when a sufficient force is exerted against a distal end of the socket body, the spring is compressed and the slide body and socket member moves proximally within the coupler. This allows the device to become flexible, wherein the socket member may be angularly displaced from the centerline of the device such that positional inaccuracies of a bolt and/or nut may be accommodated.

A device of the present invention may be associated with an automated fastener installation device. Such a device may be robotic in nature, or may be another type of automated device. Alternatively, a device of the present invention may be employed by an associate to manually install a fastener, such as a bolt.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
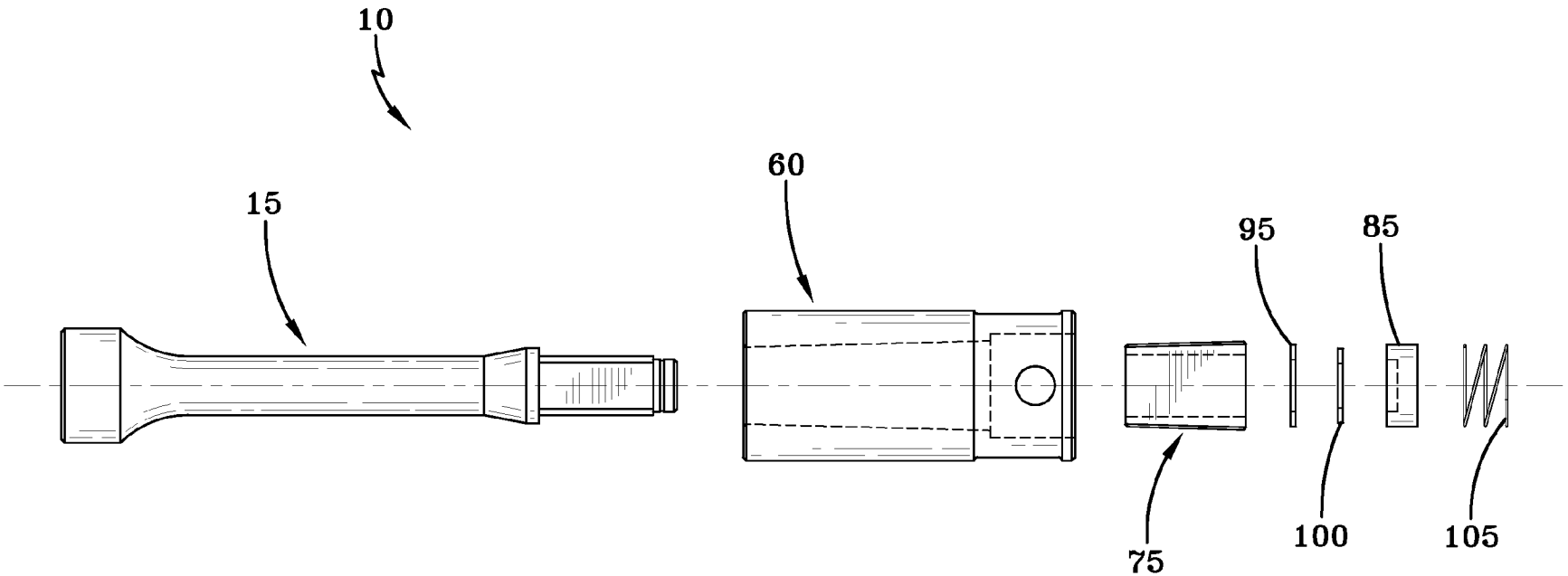
FIG. 1 is an exploded view illustrating one exemplary embodiment of a device of the present invention in a disassembled state.

FIG. 1 depicts one exemplary embodiment of a self-centering drive socket device of the present invention. As shown, this particular drive socket device 10 (hereinafter "socket device") includes, a socket member 15, a coupler 60, a sliding lock body 75 that fits within a cavity in the coupler, an optional washer 95, a retaining clip 100, a spring pad 85, and a spring 105.

Figure 2B:
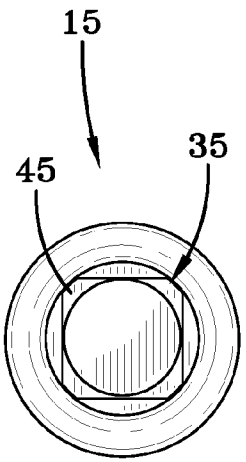
FIGS. 2*a* and 2*b* are enlarged side and end views, respectively, of an exemplary socket member of the device of FIG. 1.
Figure 2A:
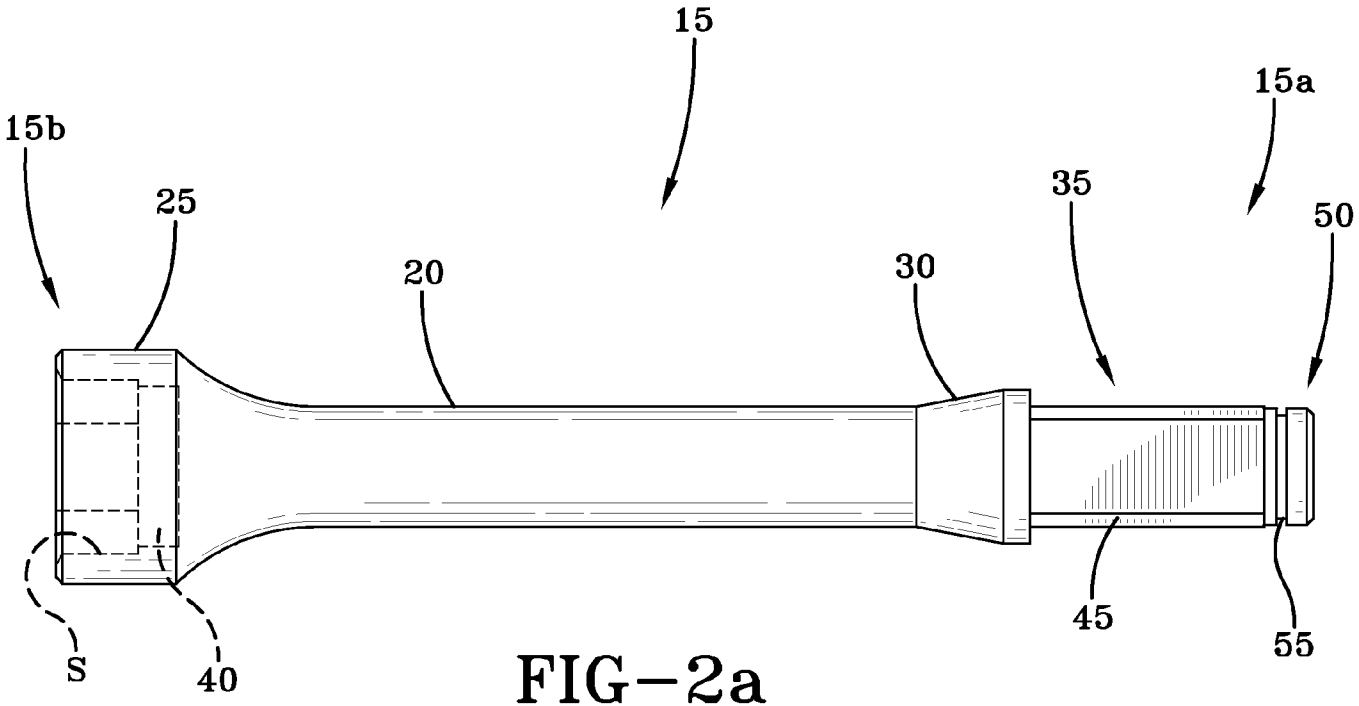

As shown in FIGS. 2*a*-2*b*, the socket member includes a proximal end 15*a* and a distal end 15*b*. Exemplary embodiments of the socket member 15 may include an extension portion 20, a fastener engaging portion 25, a shoulder portion 30 and a coupling portion 35. In this embodiment, the extension portion 20 of the socket member 15 is substantially cylindrical in shape to promote symmetry and reduce vibration during operation of the device 10. As such, the extension portion 20 may be manufactured from readily available sizes of round stock, thereby reducing manufacturing time and expense. However, it should be realized that the extension portion 20 may have any number of cross-sectional geometries.

The fastener engaging portion 25 of the socket member 15 includes an internal fastener engaging structure S which, in this case, is a socket well adapted to engage the head of a bolt. The fastener engaging portion 25 is shown here to be of substantially circular shape, but other shapes are also possible. While this embodiment of the fastener engaging portion contains a socket well, other embodiments may instead include a screwdriver head component, hex head component, TORX head component, drill head component, or another engaging structure that can drive a fastener by rotational movement.

In some embodiments, the fastener engaging portion 25 may be integral with the extension portion 20, such as by molding or turning. In other embodiments, the fastener engaging portion 25 may be attached to the extension portion 20, such as by welding. Alternatively, the fastener engaging portion 25 may be removably attached to the extension portion 20 so that the device 10 may be used with fasteners of various size. Such may be accomplished by forming a socket retaining post (not shown) on a distal end of the fastener extension portion 20, such that different sockets may be removably attached thereto. Socket retaining posts are commonly employed on ratcheting socket wrenches and similar tools to provide for socket interchangeability. The socket retaining post may employ a spring-loaded ball (not shown) or another known technique to assist in retention of the socket.

In certain embodiments of the present invention, the fastener engaging portion 25 may include a magnet 40 that facilitates releasable retention of a bolt or nut therein. The magnet 40 may be recessed into the end of the extension portion 20 so as to be operable with exchangeable fastener engaging portions 25 (e.g., sockets), or may be included in a given socket or other fastener driving tool that will be installed to the extension portion. Other magnet locations may also be possible, depending largely on the geometry of the associated fasteners with which the device will be used.

The coupling portion 35 of the socket member 15 is shown to be located at the proximal end 15*a* thereof. The coupling portion 35 of the socket member 15 is used to retain the sliding lock body 75 on the socket member and to retain the socket member and sliding lock body within a cavity 65 in the coupler 60.

In this example, the coupling portion 35 includes a forward section 45 that is substantially square in cross-section. The forward section 45 may also be of other cross-sectional shapes. As will be explained in more detail below and as shown in the drawing figures, the forward section 45 of the coupling portion 35 is received in a like-shaped cavity in the sliding lock body 75. The coupling portion also includes a rearward section 50 that is substantially circular in cross-section (although other shapes are also possible) and includes a retaining clip groove 55 designed to receive a retaining clip 100. As detailed below, the retaining clip 100 is provided to secure the sliding lock body 75 on the coupling portion 35 of the socket member 15.

In this particular embodiment, the retaining clip groove 55 is located at a distance from a face of the shoulder 30 that is approximately equal to the length of the sliding lock body 75 plus the width of the washer 95 to reduce or eliminate axial movement of the sliding lock body on the socket member 15 after the retaining clip 100 has been secured thereto. The washer 95 is positioned between the retaining clip 100 and a proximal end 75*a* of the sliding lock body 75 to help distribute the load applied to the retaining clip. Although this example includes a washer, other embodiments may be designed and assembled without a washer. For example, the retaining clip groove 55 may be located such that an associated retaining clip is in direct contact with the proximal end 75*a* of the sliding lock body 75 when installed. Further, although, one skilled in the art would realize that there may be other ways to secure a sliding lock body to a socket member of the present invention, such as by use of a set screw, etc.

The socket member 15 may be made of any number of materials, such as, for example, tool-grade steels. Whatever material is selected, however, the resulting socket member 15 should have sufficient strength to withstand the torque requirements of every day use.

Figure 3B:
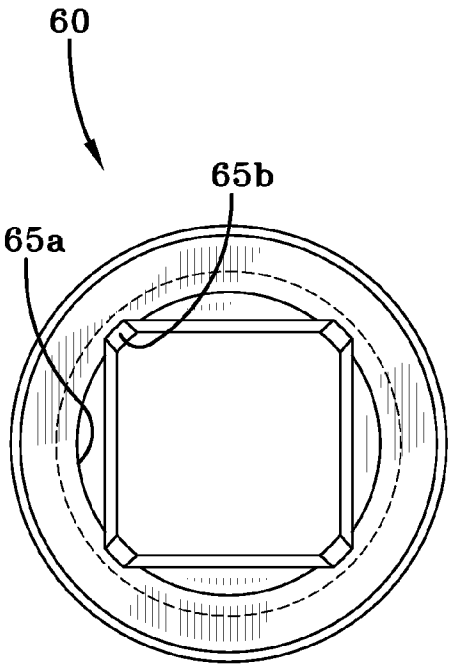
FIGS. 3*a* and 3*b* are enlarged side and end views, respectively, of an exemplary coupler of the device of FIG. 1.
Figure 3A:
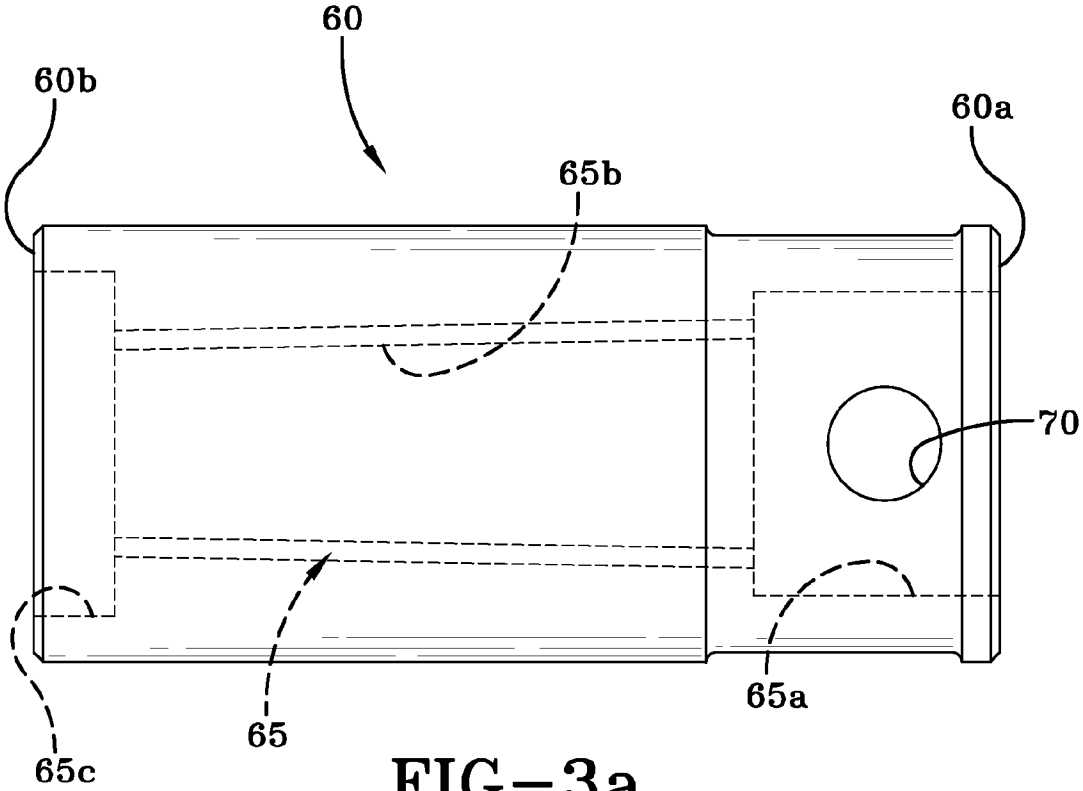

The exemplary coupler 60 of FIG. 1 can be seen in more detail in FIGS. 3*a*-3*b*. As shown, the coupler 60 has a proximal end 60*a* and a distal end 60*b* and is of substantially cylindrical shape, although other shapes are also possible. The coupler 60 includes a stepped internal cavity 65 that passes axially therethrough. A first (proximal) section 65*a* of the cavity 65 is adapted to receive a driving element of a driver tool, and may be of any shape required to produce mating engagement therebetween. A detent pocket or hole 70 may be provided in the coupler 60 to receive a spring-loaded ball or other retention element (e.g., pin) associated with such a driver tool. An optional distal recess 65*c* is located in a distal end 60*b* of this particular coupler 60. The distal recess 60*b* may be of various shape, although a round shape simplifies manufacturing. The distal recess 65*c* allows for the installation of an optional seal (not shown). Such a seal may be used to help prevent particulate matter from entering the coupler cavity 65.

In between the proximal section 65*a* of the cavity 65 and the distal recess 65*c* lies a middle cavity section 65*b*. The middle section 65*b* of the cavity 65 is substantially square in cross-section in this embodiment so as to receive and engage the sliding lock body 75 as explained below. The middle section 65*b* of the cavity 65 may be of other cross-sectional shapes in other embodiments as required to receive and engage a correspondingly shaped sliding lock body. The middle section 65*b* of the cavity 65 tapers inward as it extends from the proximal section 65*a* of the cavity toward the point of its opening into the distal recess 65*c*. Consequently, the cross-sectional area of the middle section 65*b* of the cavity 65 is greater near the proximal section 65*a* of the cavity than it is near the distal recess 65*c*. The middle section 65*b* of the cavity 65 tapers inward at an angle of approximately 3 degrees in this exemplary embodiment. However, the use of other angles of taper is possible and may depend on the taper of the associated sliding lock body.

Figure 4B:
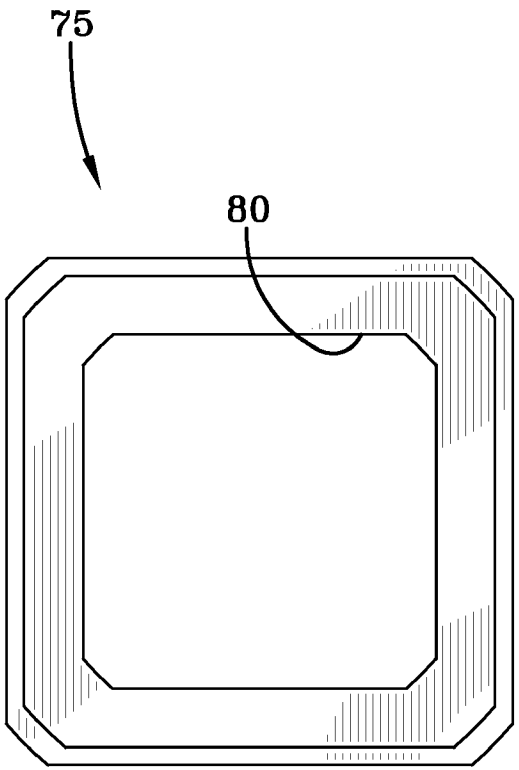
FIGS. 4*a* and 4*b* are enlarged side and end views, respectively, of an exemplary slide body of the device of FIG. 1.
Figure 4A:
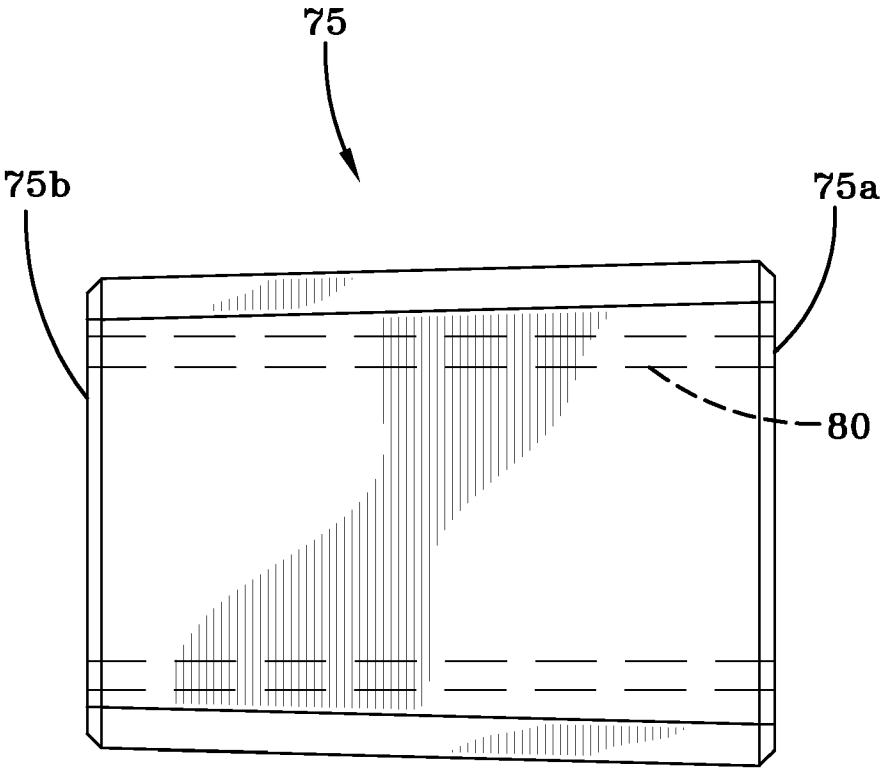

The exemplary sliding lock body 75 of FIG. 1 can be observed in more detail in FIGS. 4*a*-4*b*. As shown, the sliding lock body 75 is of substantially square cross-section and includes an internal cavity 80 of a size and shape designed to correspond to and receive the forward section 45 of the coupler portion 35 of the socket member 15. The outside of the sliding lock body 75 is tapered in a like manner to the middle section 65*b* of the cavity 65 in the coupler 60. That is, the exterior of the sliding lock body 75 tapers inward from the proximal end 75*a* to the distal end 75*b* thereof. Consequently, when the device 10 is properly assembled, the sliding lock body 75 functions as a wedge when pushed toward the distal end 60*b* of the coupler 60. The exterior corners of the joining faces of the sliding lock body 75 and/or at least the edges of the distal end of the sliding lock body may be rounded or chamfered to reduce the likelihood that the sliding lock body may stick within the cavity 65*b* of the coupler 60. It is also contemplated that the walls of the cavity 65*b* and/or the exterior of the sliding lock body 75 may be coated or otherwise covered with a low friction material for the same purpose.

Figure 5B:
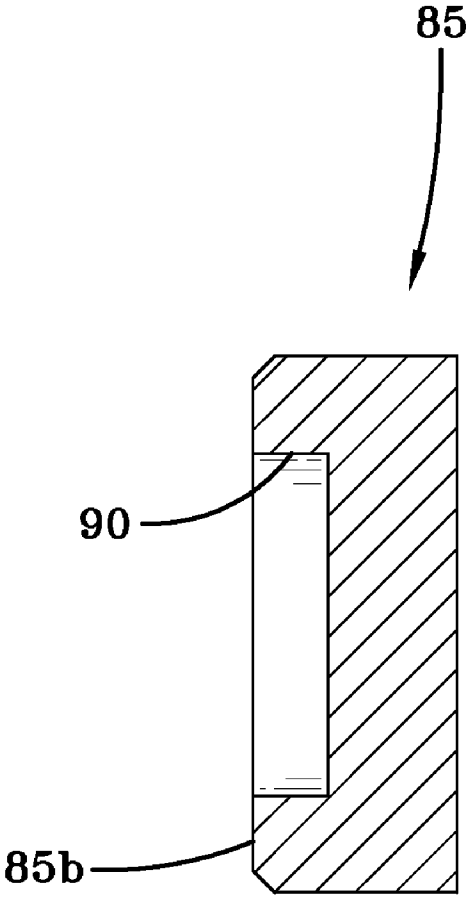
FIGS. 5*a* and 5*b* are enlarged end and side section views, respectively, of an exemplary spring pad of the device of FIG. 1.
Figure 5A:
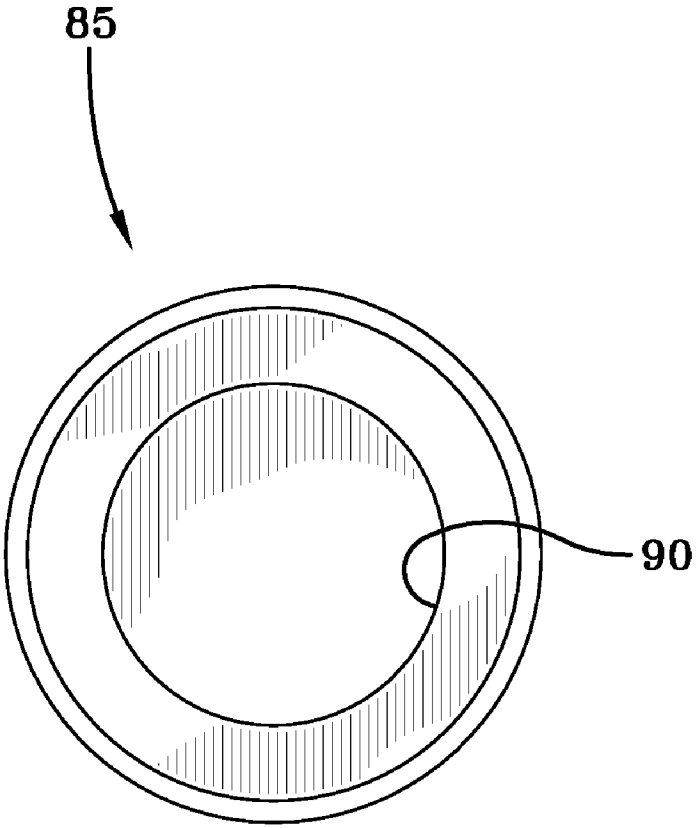

The spring pad 85 shown in FIG. 1 is depicted in more detail in FIGS. 5*a*-5*b*. As shown, the spring pad 85 is essentially a disc designed to reside between the proximal end 15*a* of the socket member 15 and the spring 105 when the socket device 10 is assembled. This particular spring pad 85 includes a cavity or recess 90 in a distal face 85*b* thereof. The recess 90 is provided to receive a portion of the proximal end 15*a* of the socket member 15 when the socket device 10 is assembled. Consequently, the recess 90 helps to keep the spring pad 85 aligned with the socket member 15, but is not critical to the present invention. The spring pad 85 provides a bearing surface against which the spring 105 can press. In other embodiments, it may be possible to eliminate the spring pad 85 and to instead allow the spring 105 to press directly against the retaining clip 100 or washer 95.

Figure 6:
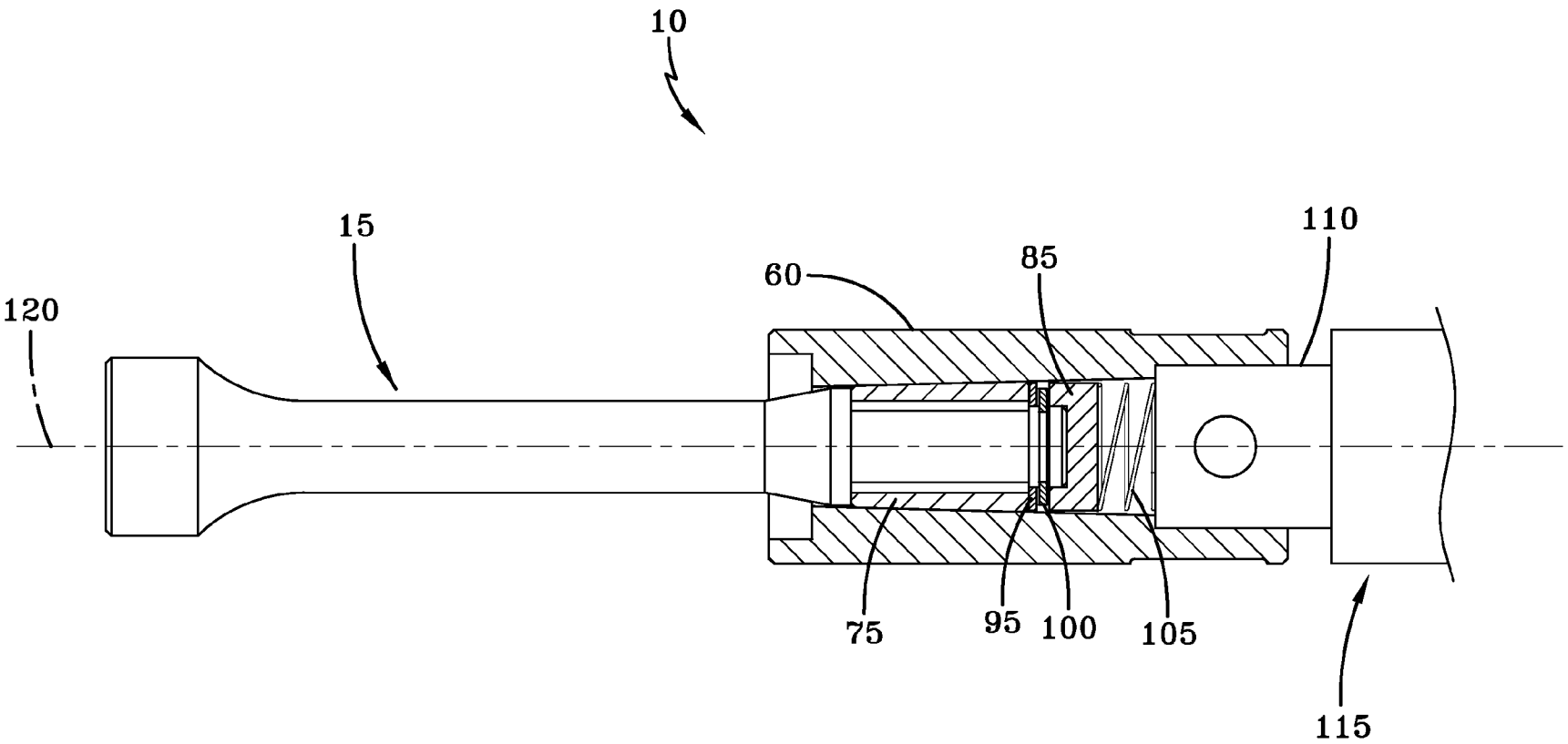
FIG. 6 is an enlarged and partially transparent side view of the device of FIG. 1 in an assembled normal position, the device being secured to an exemplary drive mechanism.

The socket device 10 of FIG. 1 is shown in an assembled state in FIG. 6. As shown, the socket member 15 is passed into the cavity 65 of the coupler 60, and the sliding lock body 75 is placed over the forward section 45 of the coupler portion 35 of the socket member. With the sliding lock body 75 properly positioned, the washer 95 and retaining clip 100 are installed, thereby securing the sliding lock body to the socket member 15. The spring pad 85 is then placed into the cavity 65 of the coupler 60 to engage the proximal end 15*a* of the socket member 15, the spring 105 is placed in the cavity of the coupler, and the socket device 10 is installed onto a coupling element 110 of a driver tool 115 as shown.

Typically, the spring 105 is a compression coil spring, but may also be another type of elastic element, such as an element comprised of a visco-elastic polymer. As can be seen, the spring 105 biases the sliding lock body 75 and socket member 15 toward the distal end 60*b* of the coupler 60. Therefore, when no (or an insufficient) contrary (compression) force is exerted against the socket member 15, the components of the socket device 10 are maintained in the arrangement shown in FIG. 6. Particularly, in a normal device state, the spring 105 wedges the sliding lock body 75 into contact with the interior walls of the middle section 65*b* of the cavity 65 in the coupler. As such, the socket member 15 and the coupler 60 are substantially concentrically arranged and aligned about a common (central) longitudinal axis 120. This ensures that the socket member 15 will be always be in the same position when the device 10 is in its normal state, allowing such a device to be used with robotic or other automated equipment where repeatable positioning is necessary. When in the state shown in FIG. 6, the socket device 10 is also substantially rigid and capable of picking up a fastener. Due to the engagement of the sliding lock body 75 with the middle section 65*b* of the cavity 65 in the coupler 60, the socket device 10 is also capable of rotatably driving a fastener.

As explained previously, when such a socket device 10 is used, it is possible that a fastener to be picked up by the socket device or a nut or other receiving element (hereinafter "nut" for simplicity) to which the fastener will be installed may be out of position. This may create a misalignment between the socket device 10 and the fastener, or between the fastener and the nut. With a traditional fastener installation tool, this would typically result in the problem fastener being missed, or in the fastener not being installed to the nut or installed in a cross-threaded manner.

Figure 7:
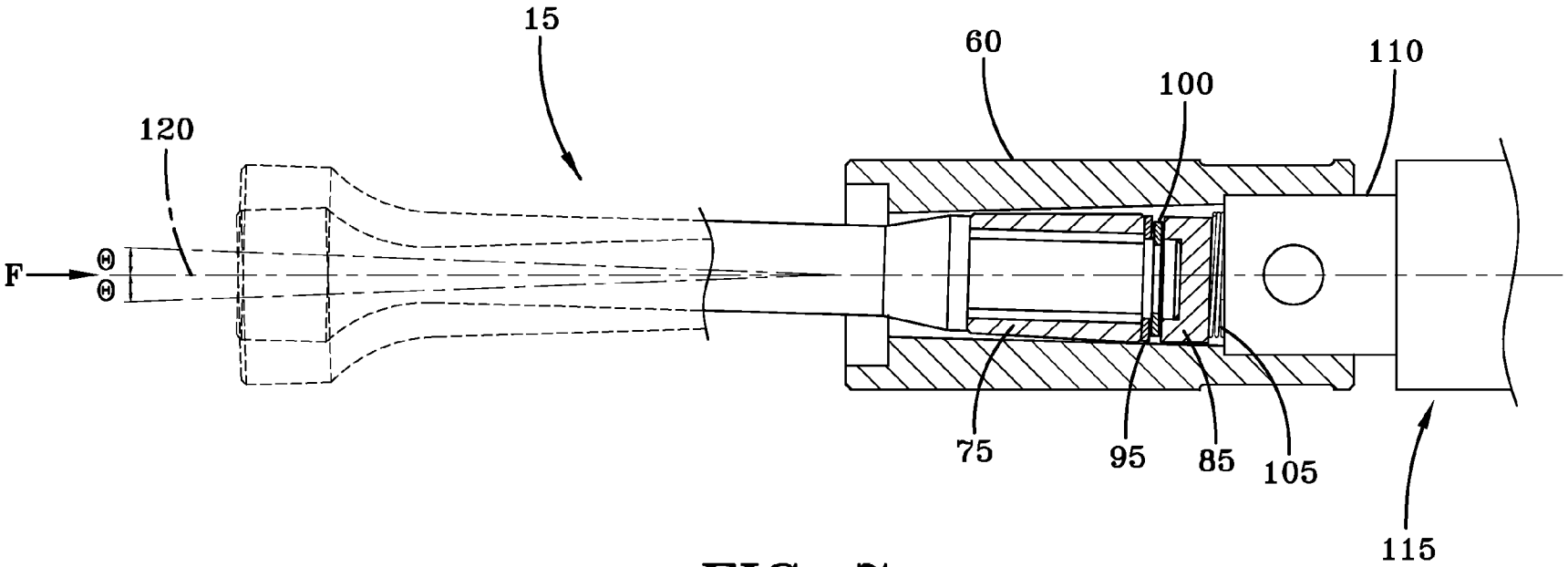
FIG. 7 illustrates a range of socket member angular displacement upon disengagement of the slide body from the coupler.

A socket device of the present invention overcomes this problem, as illustrated in FIG. 7. Particularly, when the socket member 15 is contacted with a portion of an out-of-position fastener or with a misaligned nut, exerting a pressing force F against the socket member that is sufficient to overcome the extension force of the spring 105 places the device into a released state by allowing the sliding lock body 75 and attached socket member to move toward the proximal end 60*a* of the coupler 60. Such movement releases the sliding lock body 75 from engagement with the walls of the tapered middle section 65*b* of the coupler cavity 65. Consequently, the socket member 15 is allowed to pivot within the coupler 60 and to become angularly displaced with respect to the axial centerline 120 of the device 10. This angular displacement 8 will often be sufficient for the socket member 15 to engage an out-of-position fastener or to engage a fastener with a misaligned nut. Also, because of the non-circular shape and resulting engagement of the sliding lock body 75 and the middle section 65*b* of the coupler cavity 65, the socket device 10 is still able to rotatably drive a fastener even when the socket member 15 is in an angularly displaced position.

As would be understood by one of skill in the art, the amount of angular displacement through which the socket member of a given device is able to move may be controlled. Likewise, the amount of force that must be exerted against the socket member before the bias of the spring is overcome and the socket member is released can also be adjusted.

As described previously, embodiments of the present invention may be used in an automated operation, or by hand. As shown in FIGS. 6-7, the socket device 10 is attached to a robot or other automated mechanism. Specifically, the device is mounted to a servo-driven bolt driver that is attached to a robot end effector. In this manner, a fastener of interest may be selected and installed to a corresponding like-threaded fastener of a component assembly, etc. As explained above, the socket member may releasably retain the fastener by magnetic force until installation thereof is initiated. Alternatively, it is possible to use an adhesive material to generate increased retention force between a fastener and an engaging portion of a socket member. When used, such an adhesive material may be applied to one or both of fastener and the socket member. Such an adhesive material may also act as a temporary lubricant that reduces the force required to insert a fastener into a corresponding element.

As mentioned above, it is also possible to use a device of the present invention to manually install a fastener. A manually operated operation may employ any embodiment of a device of the present invention. For example, the device shown and described herein may be attached to a ratcheting mechanism or some other dedicated and manually operated apparatus designed to effect installation of fasteners.

Whether designed for manual or automatic operation, a device of the present invention may be associated with an automatic loading (feeding) device. Such a feeding device is operative to automatically supply fasteners to the engaging portion of a device of the present invention. For example, a supply of bolts or nuts may be maintained in a stacked arrangement within a feed tube, the feed tube associated with the engaging body of a device of the present invention.

While certain embodiments of the present invention are described in detail above, the scope of the invention is not to be considered limited by such disclosure, and modifications are possible without departing from the spirit of the invention as evidenced by the following claims:

What is claimed is:

1. A self-centering drive device for use with a driving mechanism having a drive shaft, comprising:

a socket member having a fastener engaging portion located at a distal end thereof and a coupling portion located at a proximal end thereof;

a coupler with a tapered internal cavity, the cavity designed to receive a portion of the proximal end of the socket member and having a non-circular cross-section that tapers inward along a proximal to distal direction;

a sliding lock body having a cavity for non-rotatably receiving a corresponding section of the coupling portion of the socket member, and an exterior that substantially corresponds in shape to the cavity in the coupler;

a retaining clip for engaging a groove in the coupling portion of the socket member, said retaining clip for securing the sliding lock body on the socket member; and a spring for installation into the cavity in said coupler so as to bias the socket member and sliding lock body toward a distal end of the coupler when the self-centering drive device is installed to a driving mechanism;

wherein, in a normal state, the socket member and coupler are substantially aligned about a central axis; and wherein, in a released state, the socket member is freely angularly displaceable from the central axis.

2. The device of claim 1, further comprising a shoulder between the proximal end and distal end of the socket member, the shoulder acting as a stop against which a distal end of the sliding lock body rests when installed on the socket member.

3. The device of claim 2, wherein at least a portion of the shoulder of the socket member is received in the internal cavity of the coupler.

4. The device of claim 1, wherein the coupling portion of the socket member includes a forward section of non-circular cross section and the cavity in the sliding lock body is of corresponding shape.

5. The device of claim 1, wherein the coupler further comprises a detent pocket or hole for receiving a corresponding retention element of a drive mechanism.

6. The device of claim 1, further comprising a washer positioned between the retaining clip and a proximal end of the sliding lock body.

7. The device of claim 1, further comprising a spring pad interposed between the spring and the retaining clip, the spring pad having a recess that receives a portion of the proximal end of the socket member.

8. The device of claim 1, wherein the configuration of the fastener engaging portion of the socket member is selected from the group consisting of a socket well, a screwdriver bit, a hex head bit, and a TORX bit.

9. The device of claim 1, wherein the socket member further comprises a magnet set into the distal end thereof for releasably retaining a fastener by magnetic force.

10. A self-centering drive device for use with a driving mechanism having a drive shaft, comprising:

a socket member having a fastener engaging portion located at a distal end thereof and a coupling portion located at a proximal end thereof, the coupling portion having a forward section of non-circular cross-section and a rearward section;

a coupler with a tapered internal cavity, the cavity designed to receive a portion of the proximal end of the socket member and having a non-circular cross-section that tapers inward along a proximal to distal direction;

a sliding lock body having a cavity for receiving and engaging the forward section of the coupling portion of the socket member, and an exterior that tapers in a proximal to distal direction and that substantially corresponds in shape to the cavity in the coupler;

a retaining clip for engaging a groove in the rearward section of the coupling portion of the socket member, said retaining clip for securing the sliding lock body on the socket member; and a spring for installation into the cavity in said coupler so as to bias the socket member and sliding lock body toward a distal end of the coupler when the self-centering drive device is installed to a driving mechanism;

wherein, in the absence of an overpowering compression force on the socket member, the spring maintains the sliding lock body in engaged contact with walls of the cavity in the coupler such that the socket member and coupler are substantially aligned about a central axis; and wherein, upon application of an overpowering compression force on the socket member, the spring is compressed, releasing the sliding lock from contact with walls of the cavity in the coupler such that the socket member is freely angularly displaceable from the central axis.

11. The device of claim 10, further comprising a shoulder between the proximal end and distal end of the socket member, the shoulder acting as a stop against which a distal end of the sliding lock body rests when installed on the socket member.

12. The device of claim 11, wherein at least a portion of the internal cavity of the coupler accepts at least a portion of a driving shaft of a drive mechanism.

13. The device of claim 11, wherein the coupler further comprises a detent pocket or hole for receiving a corresponding retention element of a drive mechanism.

14. The device of claim 11, further comprising a washer positioned between the retaining clip and a proximal end of the sliding lock body.

15. The device of claim 11, further comprising a spring pad interposed between the spring and the retaining clip, the spring pad having a recess that receives a portion of the proximal end of the socket member.

16. The device of claim 11, wherein the configuration of the fastener engaging portion of the socket member is selected from the group consisting of a socket well, a screwdriver bit, a hex head bit, and a TORX bit.

17. The device of claim 11, wherein the socket member further comprises a magnet set into the distal end thereof for releasably retaining a fastener by magnetic force.

18. A self-centering drive device for use with a driving mechanism having a drive shaft, comprising:

a socket member having a fastener engaging portion located at a distal end thereof and a coupling portion located at a proximal end thereof, the coupling portion having a forward section of non-circular cross-section and a rearward section with a clip retaining groove, the socket member further including a shoulder located between the proximal end and distal end thereof, the shoulder acting as a stop against which a distal end of a sliding lock body rests when installed on the socket member;

a coupler with a stepped internal cavity, a proximal section of the cavity adapted for engagement with at least a portion of a driving shaft of a drive mechanism, a middle portion of the cavity designed to receive a portion of the proximal end of the socket member and a sliding lock body and having a non-circular cross-section that tapers inward along a proximal to distal direction;

a sliding lock body having a cavity for receiving and engaging the forward section of the coupling portion of the socket member, and an exterior that tapers in a proximal to distal direction and that substantially corresponds in shape to the middle portion of the cavity in the coupler;

a retaining clip for engaging the groove in the rearward section of the coupling portion of the socket member, said retaining clip for securing the sliding lock body on the socket member;

a washer interposed between the retaining clip and a proximal end of the sliding lock body;

a spring for installation into the cavity in said coupler so as to bias the socket member and sliding lock body toward a distal end of the coupler when the self-centering drive device is installed to a driving mechanism; and a spring pad interposed between the spring and the retaining clip, the spring pad having a recess that receives a portion of the proximal end of the socket member;

wherein, in the absence of an overpowering contrary force on the socket member, the spring maintains the sliding lock body in engaged contact with walls of the cavity in the coupler such that the socket member and coupler are substantially aligned about a central axis; and wherein, upon application of an overpowering contrary force on the socket member, the spring is compressed, releasing the sliding lock from contact with walls of the cavity in the coupler such that the socket member is freely angularly displaceable from the central axis.

19. The device of claim 18, wherein the configuration of the fastener engaging portion of the socket member is selected from the group consisting of a socket well, a screwdriver bit, a hex head bit, and a TORX bit.

20. The device of claim 18, wherein the socket member further comprises a magnet set into the distal end thereof for releasably retaining a fastener by magnetic force.

* * * * *